United States Patent [19]

Saalasti

[11] Patent Number: 4,651,639

[45] Date of Patent: Mar. 24, 1987

[54] DEWATERING PRESS AND GEARBOX FOR SAME

[76] Inventor: Vaino T. Saalasti, Arinatie 4, SF-00370 Helsinki 37, Finland

[21] Appl. No.: 604,159

[22] Filed: Apr. 26, 1984

[30] Foreign Application Priority Data

Oct. 27, 1983 [FI] Finland ..... 833933

[51] Int. Cl.[4] ..... B30B 9/20

[52] U.S. Cl. ..... 100/121; 100/905

[58] Field of Search ..... 100/121, 157, 905

[56] References Cited

U.S. PATENT DOCUMENTS 2,682,832 7/1954 Lohre et al. ..... 100/121

3,000,294 9/1961 Lowe et al. ..... 100/121

FOREIGN PATENT DOCUMENTS 3044204 8/1981 Finland ..... 100/121

*Primary Examiner*—Peter Feldman

*Attorney, Agent, or Firm*—Browdy and Neimark

[57] ABSTRACT

Dewatering press, which is provided with a perforated rotary drum and with a press roll revolving inside the drum, between which the material to be dewatered is compressed and wherein the compressing force of the press roll is produced by means of compression levers, on which the shaft of the press roll is journalled, and the rotary movement of the roll is produced by means of a gearbox, which has been made so that a compression lever and an ordinary pivot gearbox have been built together, whereby the entire machine becomes of shorter length, of lower weight, and simpler.

8 Claims, 4 Drawing Figures

DEWATERING PRESS AND GEARBOX FOR SAME

The present invention is concerned with such continuous dewatering presses, and gearboxes for same, as comprise a revolving drum and a press roll revolving inside the drum, the said press roll being pressed by means of compression arms with a high power against the material to be dewatered, e.g. bark.

Presses of this type are, e.g., the presses in accordance with the Finnish Pat. No. 62,330 and the Finnish Patent Applications Nos. 79,3701 and 82,3914.

For example, FIG. 1 in the FI Patent Application No. 82,3914, "Mechanical continuous dewatering press", shows the compression lever 2 as viewed in the direction of the shaft of the roll. At the middle in the compression lever, there is a bearing housing 10, which is provided with a large spherical roller bearing, which presses the shaft of the roll downwards at a high force, of more than 100 tons.

The ends of the shaft of the roll go up and down in accordance with the thickness of the material layer to be dewatered, and thereat the inner and outer rings of this large spherical bearing also turn relative each other to a considerable extent, about 2° to 2.5°. This makes the sealing of the bearings difficult.

FIG. 2 is a side view of the press. On the shaft 2′ of the roll, at the side of the lower end of the drum, there is a compression lever 11, and the end of the shaft 2′ is provided with a gearbox 17. In the gearbox, there is a large drive cogwheel at the centre and large roller bearings at both sides of the cogwheel, the inner diameter of the said bearings being about 400 mm.

This construction makes the press long and heavy, the sealing of the spherical roller bearing in the compression lever is difficult to perform, and the construction is also of high cost, because it comprises three large bearings.

It is an object of the present invention to eliminate these drawbacks in a simple way.

The dewatering press in accordance with the invention, provided with a rotary drum, a roll, and with compression arms pressing the roll, and the gearbox for the press are characterized by the circumstances stated in the characterizing part of claim 1.

The invention will be described in more detail with the aid of the attached drawings. Therein, as an example is illustrated the dewatering press in accordance with the FI Patent Application No. 82,3914 (disclosed in applicant's copending application, Ser. No. 604,158, filed Apr. 26, 1984, incorporated herein by reference) as well as a press in accordance with the invention and a gearbox for same, FIGS. 3 and 4. The construction in accordance with the invention may be varied within the scope of the patent claims, for the application is only supposed to disclose the principle of combination of a compression lever and a pivot gearbox and the application of the said principle to the dewatering press.

FIGS. 1 and 2 show a dewatering press in accordance with the FI Patent Application No. 82,3914, which is intended in particular for the dewatering of the bark of a tree. The operation of the press is described in the description of the Patent Application No. 82,3914.

Figure 1:
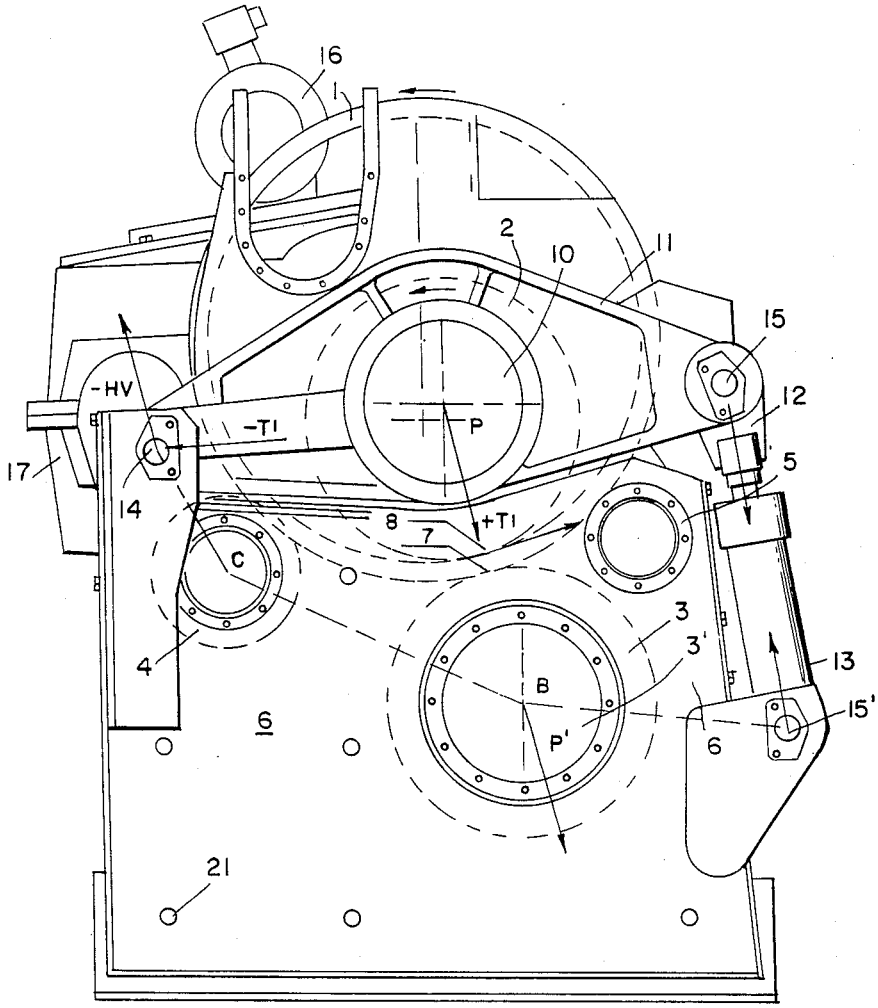
FIG. 1 shows a dewatering press in accordance with the FI Patent Application No. 82,3914 as viewed from the upper end in the direction of the axis.
Figure 2:
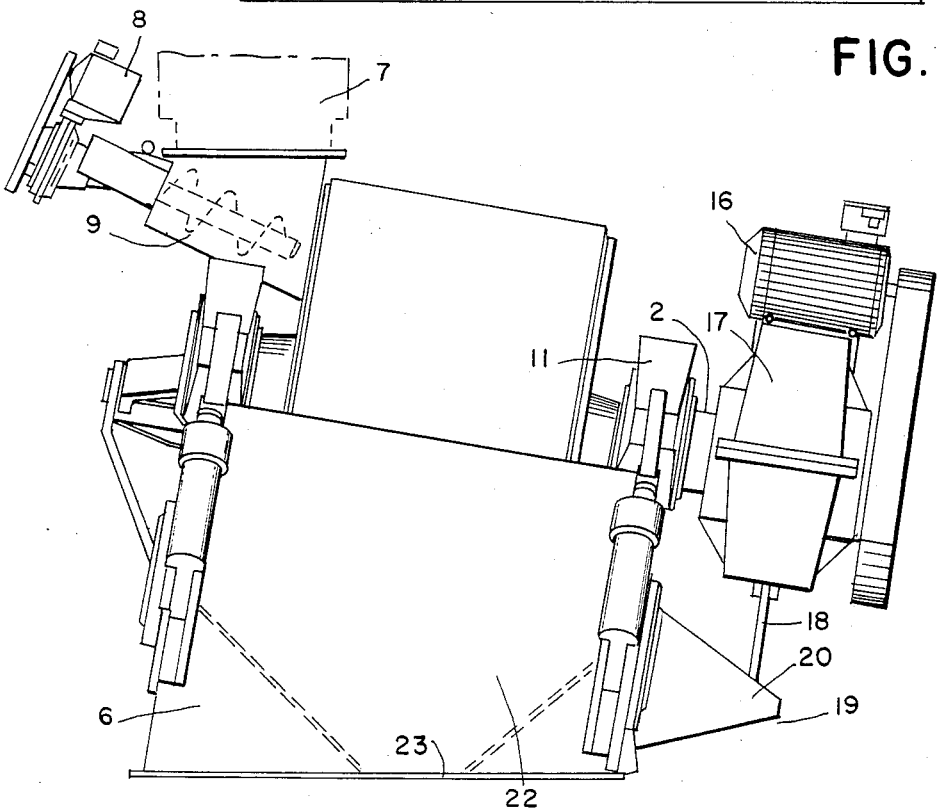
FIG. 2 shows the press in accordance with the Application No. 82,3914 as a side view.

Briefly described, the operation is as follows. The wet bark arrives on a conveyor 7, FIG. 2, and falls onto a screw feeder 9 driven by an electric motor 8. The screw feeder pushes the wet bark to between the revolving roll 2 and the perforated drum 1, shown in FIG. 1, where the bark, having fallen down, is compressed between them and the water flows down out of the water space 22 and down through the opening 22′. At the other side of the roll, the bark rises and, having passed across the roll, falls down again in a new position to be compressed again. The compression takes place 4 to 5 times. Owing to the inclined position of the machine, the bark is shifted a little on each falling down, 10 to 15 cm forwards, and the dewatered bark is removed out of the bottom end of the machine onto a belt 31, FIG. 4.

Figure 3:
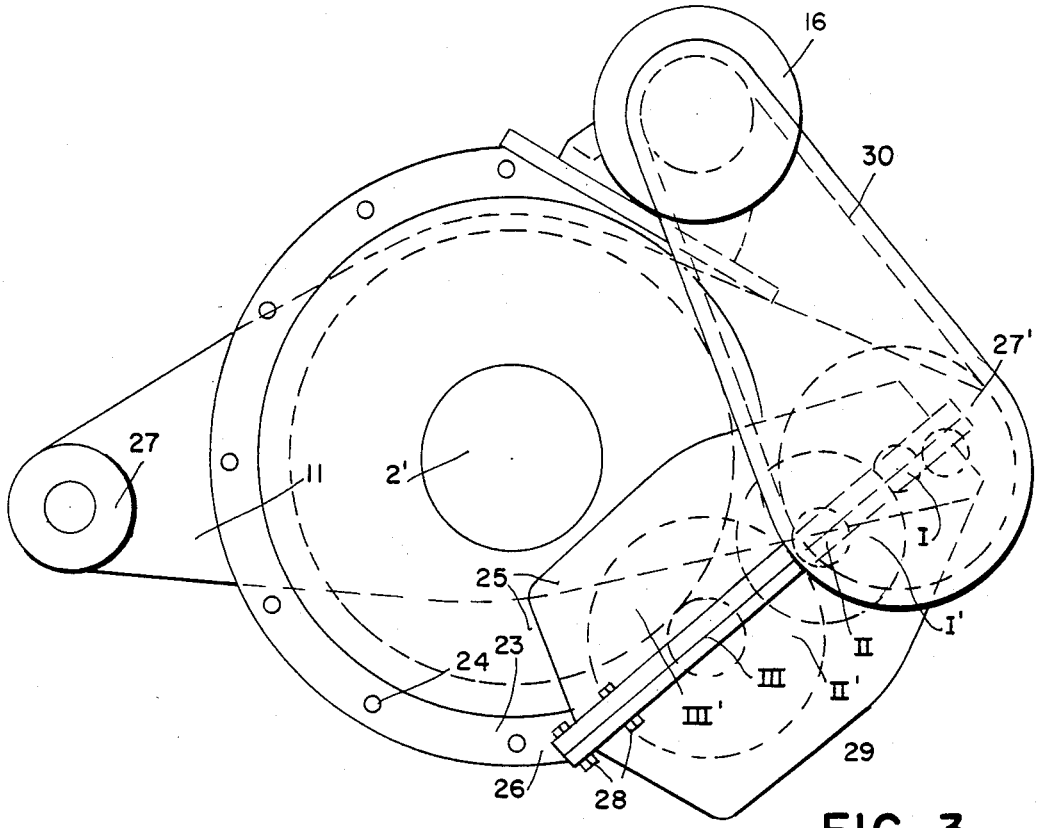
FIG. 3 shows a gearbox in accordance with the present invention as viewed from the end next to the gearbox.
Figure 4:
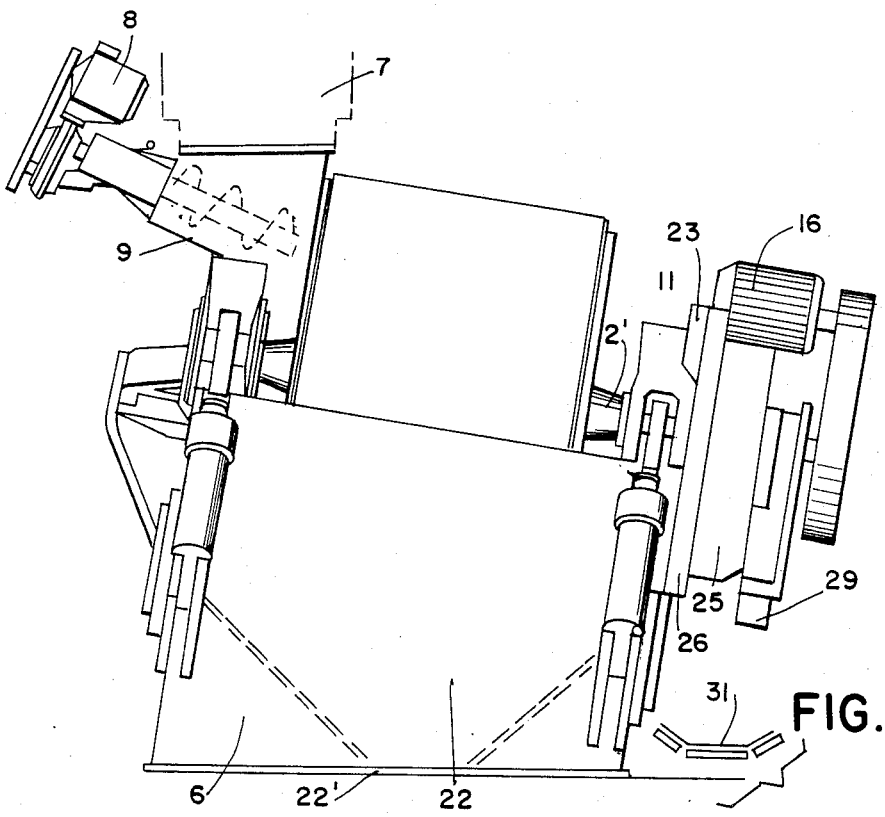
FIG. 4 shows a dewatering press in accordance with the invention as provided with a gearbox combined with the compression lever.

FIGS. 3 and 4 show how a pivot gearbox 17 normally provided with a torque support 18, with an elastic coupling 19, and with a frame projection 20 as well as a compression lever 11 (see FIG. 2) is, according to the present invention, converted to a gearbox for a dewatering press without a torque support 18, elastic coupling 20, or frame projection 19.

It should be noticed that, in the construction in accordance with the invention, only two large bearings are required in stead of the three bearings required now, and the entire machine becomes shorter.

FIGS. 3 and 4 illustrate one principle of the combination of the compression lever and the gearbox housing. One end of the compression lever 11, e.g. 27′, is mounted by means of a spherical joint to the frame of the press, and the other end, e.g. 27, to the top end of the piston of the hydraulic cylinder. When the piston pulls the lever 11 downwards at point 27, the large bearing at the middle of the lever presses the shaft 2′ downwards.

The compression lever 11 (FIGS. 3 and 4) is provided with a flange 23, to which the flange 26 of the gearbox housing 25 is attached by means of bolts 24. A housing 29 is also attached to the gearbox housing 25 by means of bolts 28. On the compression lever 11 and the housing 25, there is an electric motor 16, as there was in prior art placed on the separate pivot gearbox 17.

The electric motor 16 drives the primary shaft I of the gearbox, e.g., by means of V-belts 30, like in the prior-art gearbox. The pairs of cogwheels are also equivalent, I—I′, II—II, III—III′.

The large cogwheel III′ is placed on the shaft 2′ of the Bark Master and drives it.

Both ends 27 and 27′ of the compression lever 11 are provided with spherical joints, so that, when the shaft of the roll rises, the gearbox housing provided with two bearings can always be inclined along with the shaft 2′.

In this way, by combining the compression lever 11 and the pivot gearbox, a dewatering press of shorter length has been obtained, one large bearing less is required, and there are no problems in sealing the large spherical bearing. The overall cost of the construction is also lower. The torque support 18 and the elastic coupling 19 as well as the frame projection 20 are omitted as unnecessary. By means of the elimination of these components, the important advantage is also obtained that the conveyor 31 for the dewatered bark may be installed transversely below the outlet opening for the bark, above the floor, and no footing is necessary for the dewatering press.

What is claimed is:

1. Dewatering press having a frame, and being provided with a perforated rotary drum (1) and with a press roll (2) revolving inside the drum, between which material to be dewatered is compressed and wherein the compressing force of the press roll (2) is produced by means of a compression lever, comprising:

a shaft on which said press roll rotates;

the compression lever having one end pivotally supported on the press frame, and including a flange extending about a portion of the periphery thereof, said press roll shaft being journalled in said compression lever;

a gearbox housing including gear means for pivoting said compression lever, said gearbox housing being supported between said lever one end and said lever flange.

2. Dewatering press as claimed in claim 1, said gearbox housing is mounted on the frame of the press and the compression force of a hydraulic cylinder acts upon an opposite end of the housing.

3. Dewatering press as claimed in claim 1, wherein said gearbox housing includes bearings, one of said bearings being placed next to the drum to receive the load force of the compression lever and another bearing keeps the gearbox housing inclined along with the shaft of the roll.

4. Dewatering press as claimed in claim 1, wherein both ends of the gearbox housing are provided with spherical joints.

5. Dewatering press as claimed in claim 1, wherein a drive motor is placed on the gearbox housing.

6. Dewatering press as claimed in claim 2, wherein said gearbox housing includes bearings, one of said bearings being placed next to the drum to receive the load force of the compression lever and another bearing keeps the gearbox housing inclined along with the shaft of the roll.

7. Dewatering press as claimed in claim 2, wherein both ends of the gearbox housing are provided with spherical joints.

8. Dewatering press as claimed in claim 3, wherein both ends of the gearbox housing are provided with spherical joints.

* * * * *